US005528340A

United States Patent [19]

Sklut

[11] Patent Number: 5,528,340

[45] Date of Patent: Jun. 18, 1996

[54] ADAPTIVE COPIER/DUPLICATOR CYCLE-OUT FOR MULTIPLE MANUALLY POSITIONED ORIGINAL JOBS

[75] Inventor: Robert L. Sklut, Rochester, N.Y.

[73] Assignee: Xerox Corporation, Stamford, Conn.

[21] Appl. No.: 241,233

[22] Filed: May 11, 1994

[51] Int. Cl.[6] ..... G03G 21/00

[52] U.S. Cl. ..... 355/208; 355/200

[58] Field of Search ..... 355/203, 204, 355/208, 200

[56] References Cited

U.S. PATENT DOCUMENTS

| | | | |
|---|---|---|---|
| 4,477,180 | 10/1984 | Bustamante | 355/208 |
| 4,540,270 | 9/1985 | Imanaka et al. | 355/208 X |
| 4,627,711 | 12/1986 | Schron | 355/208 |
| 5,063,414 | 11/1991 | Shirasugi | 355/208 X |
| 5,194,895 | 3/1993 | Bares | 355/208 |
| 5,317,367 | 5/1994 | Pierce et al. | 355/203 |
| 5,355,197 | 10/1994 | Hopkins | 355/208 |
| 5,383,005 | 1/1995 | Thompson et al. | 355/208 |

*Primary Examiner*—Robert Beatty

*Attorney, Agent, or Firm*—Fay, Sharpe, Beall, Fagan, Minnich & McKee

[57] ABSTRACT

A xerographic copier is constructed to include a xerographic subsystem control which will cycle-out and deactivate the elements used for xerographic copying, including bias on the photoreceptor, and a machine subsystem control which cycles-down and produces machine shutdown. Also included in the copier is an adaptive time controller provided to adjust the time periods at which the xerographic and machine subsystem controls cycle-down and/or shutdown.

15 Claims, 5 Drawing Sheets

ADAPTIVE COPIER/DUPLICATOR CYCLE-OUT FOR MULTIPLE MANUALLY POSITIONED ORIGINAL JOBS

BACKGROUND OF THE INVENTION

The present invention relates to the xerographic arts. The invention finds particular application in controlling operation of xerographic machines and will be described with particular reference thereto.

The prior art has taught the production of copies from document originals produced by the xerographic process wherein the document original to be copied is placed on a transparent platen, either by hand or automatically through the use of a document handler. The document original is illuminated by a relatively high intensity light. Image rays reflected from the illuminated document original are focused by a suitable optical system onto a previously charged photoconductive layer of a photoreceptor. The image light rays function to discharge the photoconductive layer in accordance with the image content of the original to produce a latent electrostatic image of the original document on the photoconductive layer. The latent electrostatic image so produced is thereafter developed by a suitable developer material such as toner, and the developed image is transferred to a sheet of copy paper brought forward by a suitable feeder. The transferred image is thereafter fixed as by fusing to provide a permanent copy while the photoconductive layer is cleaned of residual developer preparatory to recharging.

A photoreceptor is at the heart of the xerographic process. During charging a photoreceptor must be able to receive and hold a charge in the dark. During exposure, the photoreceptor must release that charge from areas exposed to the light. To accomplish this the photoreceptor incorporates photoconductive material.

In addition, the photoreceptor must be constructed so that the movement of electrons can be controlled. In other words, the photoreceptor must be constructed so that charges can be placed, held, and released at different times and under different conditions. To accomplish the control of the electron movement, the photoreceptor usually also includes a substrate layer.

The substrate has four major purposes. Three purposes have a strong effect in the charging, exposing, and cleaning processes and require a substrate material which is a good conductor. First, the substrate helps to maintain a uniform charge across the surface of the photoreceptor. Second, the substrate helps to control the field strength of the photoreceptor charge. Third, the substrate provides the electrical grounding for the photoreceptor. The fourth purpose for the substrate is physical in that it acts as a base for the very thin photoconductive layer.

The substrate of most photoreceptors is made of aluminum. Aluminum is a good conductor and it is also less expensive to refine, machine, burnish, and clean than most other conductors.

It is through the photoconductive layer that charges move, based on the presence of light. Several different materials are currently used for the photoconductive layer, such as a variety of organic compounds, selenium alloys, arsenic triselenide, cadmium sulfide, or amorphous silicon. The most common of these are organic compounds and selenium alloys.

Organic compounds, by definition, are chemical compounds based on carbon. FIG. 1 discloses a typical photoreceptor which has a substrate 12 and a organic photoconductive layer 14 which has two-layer construction; a charge generation layer 16 and a charge transport layer 18. The layer closest to the substrate is the charge generation layer 16. This layer contains the charges which move when the photoreceptor is acting as a conductor. When the photoreceptor 10 is charged, the induced charges are in the charge transport layer 16. Organic photoreceptors have an additional barrier between the photoconductive layer and the substrate. This barrier, commonly called the underlayer 20, prevents the easy flow of electrons between the substrate and the upper layers.

Photoreceptors can be damaged by chemicals, such as lubricants, fusing agents, the oils on fingers, by heat, or simply by the constant exposure to paper and developing agents. This damage translates into copy or print quality defects. Photoreceptor defects can range from scratches or abrasions in the photoconductive layer to the development of a film on the surface, oxidation, or rapid crystallization.

Another common manner in which photoreceptors tend to have their effective life expectancies shortened occurs by excessive charge-erase cycles where no images are actually exposed upon the charged photoreceptor. These "wasted" exposures on the photoreceptor greatly reduce the effective life of the photoconductive surface by increasing the wear and tear on the photoconductive film. In order to reduce these wasted exposures existing xerographic machines, especially those employing organic photoconductive layers, are designed so their control systems terminate all xerographic bias potentials and erase functions as soon as is practical after a last scheduled image has been reproduced.

In the majority of situations, especially those which occur on high productivity machines which employ fully automatic document handlers, this rapid xerographic shutdown prior to the actual machine shutdown will be transparent and non-invasive since no manual operator intervention is involved between produced images. However, this rapid xerographic cycle-down tends to greatly limit operator productivity when xerographic machines are employed to reproduce copies of individual manually or operator assisted semi-automatically positioned originals. This is true since during the time when the operator is manually exchanging originals, the xerographic subsystem control may cycle-down, resulting in a long "restart" time since it becomes necessary to re-enable the xerographic subsystem for several image zones prior to actual image production due to the physical dimensions of the xerographic system. Additionally, if the time between operations extends even further, the control subsystem for the entire machine may cycle-down resulting in an even longer original-to-original copy time.

Even very proficient operators often encounter long restart times due the conservative nature of existing xerographic subsystem designs. This problem is especially bad where the platen/glass cover needs to be closed over for each original prior to copying to avoid background or operator annoyance over the illumination intensity.

The present invention contemplates a new and improved control system for a xerographic imaging device. The xerographic imaging device includes an adaptive control system to allow for a more equitable compromise between manual placement job productivity and photoreceptor life.

SUMMARY OF THE INVENTION

In accordance with one aspect of the present invention, a xerographic printing machine of the type which includes manual placement of original documents to be copied is provided. A sensor senses completion of the copying of an original document. A control system receives a signal indicating completion of the copying and removes voltage biases from elements of the xerographic printing machine after a predetermined time period following completion of the copying. An adaptive control system adaptively controls the length of the time period prior to removal of the voltage biases and or prior to total cycle-down of the machine.

In accordance with another aspect of the present invention, a method of xerographic printing control is provided. Documents to be copied are individually placed on a platen. A photoreceptor material receives bias voltages during a copying procedure for copying one of the documents which is located on the platen. The completion of the copying procedure is sensed by a sensor device. A signal indicating completion of the copy procedure is passed to a xerographic control subsystem which controls the bias received by the photoreceptor during the copy procedure. Based on receipt from the sensor of the completion of the copy procedure, the bias is removed from the photoreceptor following a first time period after the end of the copy procedure. The length of the first time period is adaptively controlled by an adaptive time controller according to predetermined parameters.

In accordance with a more limited aspect of the present method, the xerographic device enters into a cycle-down state after a second time period following the end of the copy procedure.

In accordance with yet another aspect of the present invention, a xerographic device is provided including a platen on which documents are manually or operator assisted semi-automatically placed to be copied. A photoreceptor material has bias voltages applied during a copy procedure for copying one of the documents located on the platen. Completion of the copy procedure is sensed and the xerographic subsystem control removes the bias voltages following a first time period after the end of the copy procedure. A copier or machine subsystem control which controls energization of the xerographic device, places the xerographic device into a cycle-down state following a second time period after the end of the copy procedure. An adaptive time control device adaptively alters the length of the first and second time periods according to predetermined parameters.

In a more limited aspect of the present invention, the predetermined parameters include job set up, mode of operation, and whether operation is a manual or non-manual job.

One advantage of the present invention is that a more equitable compromise between manual placement job productivity and photoreceptor life is obtained.

Another advantage of the present invention is that wasted exposures of the photoreceptor are reduced, thereby increasing photoreceptor life expectancy.

Yet another advantage resides in less time to produce manual jobs through negating extended restart times and original-to-original copy times resulting from subsystem cycle-down.

Still further advantages will be apparent to those of ordinary skill in the art upon reading and understanding the following detailed description of the preferred embodiment.

BRIEF DESCRIPTION OF THE DRAWINGS

The invention may be embodied in various steps and arrangements of steps in various components and arrangements of components. The drawings are only for purposes of illustrating a preferred embodiment and are not to be construed as limiting the invention.

DETAILED DESCRIPTION OF THE PREFERRED EMBODIMENT

Figure 1:
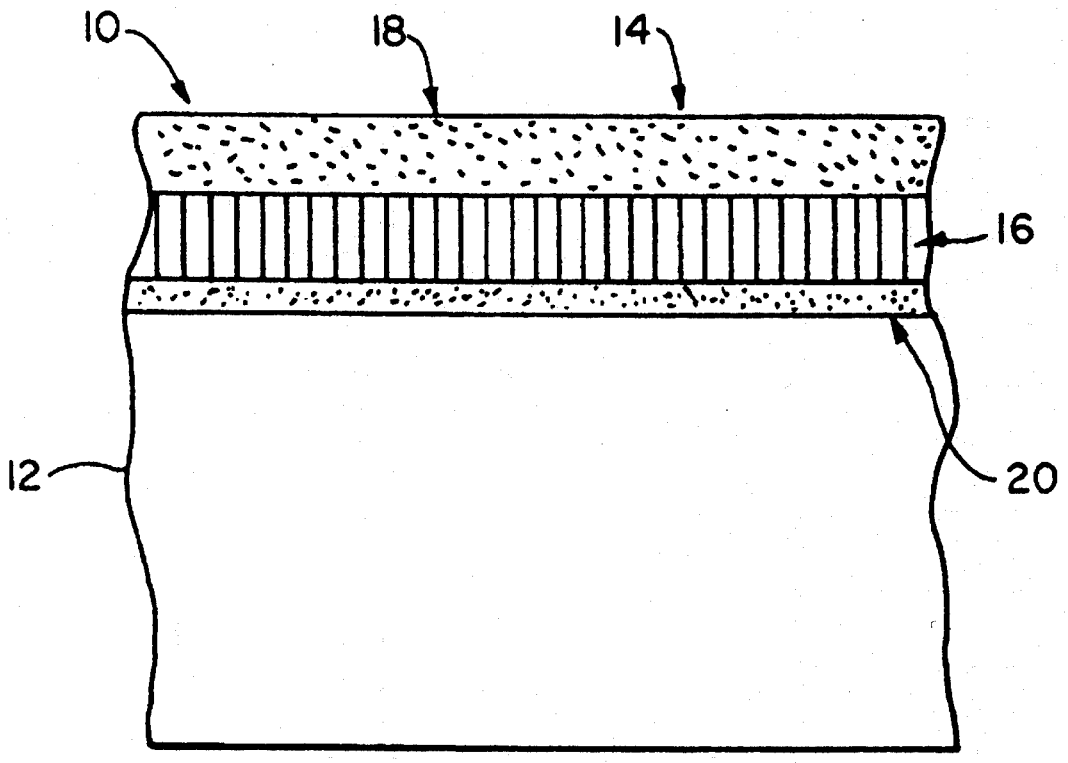
FIG. 1 is a diagrammatic side view of a photoreceptor.
Figure 2:
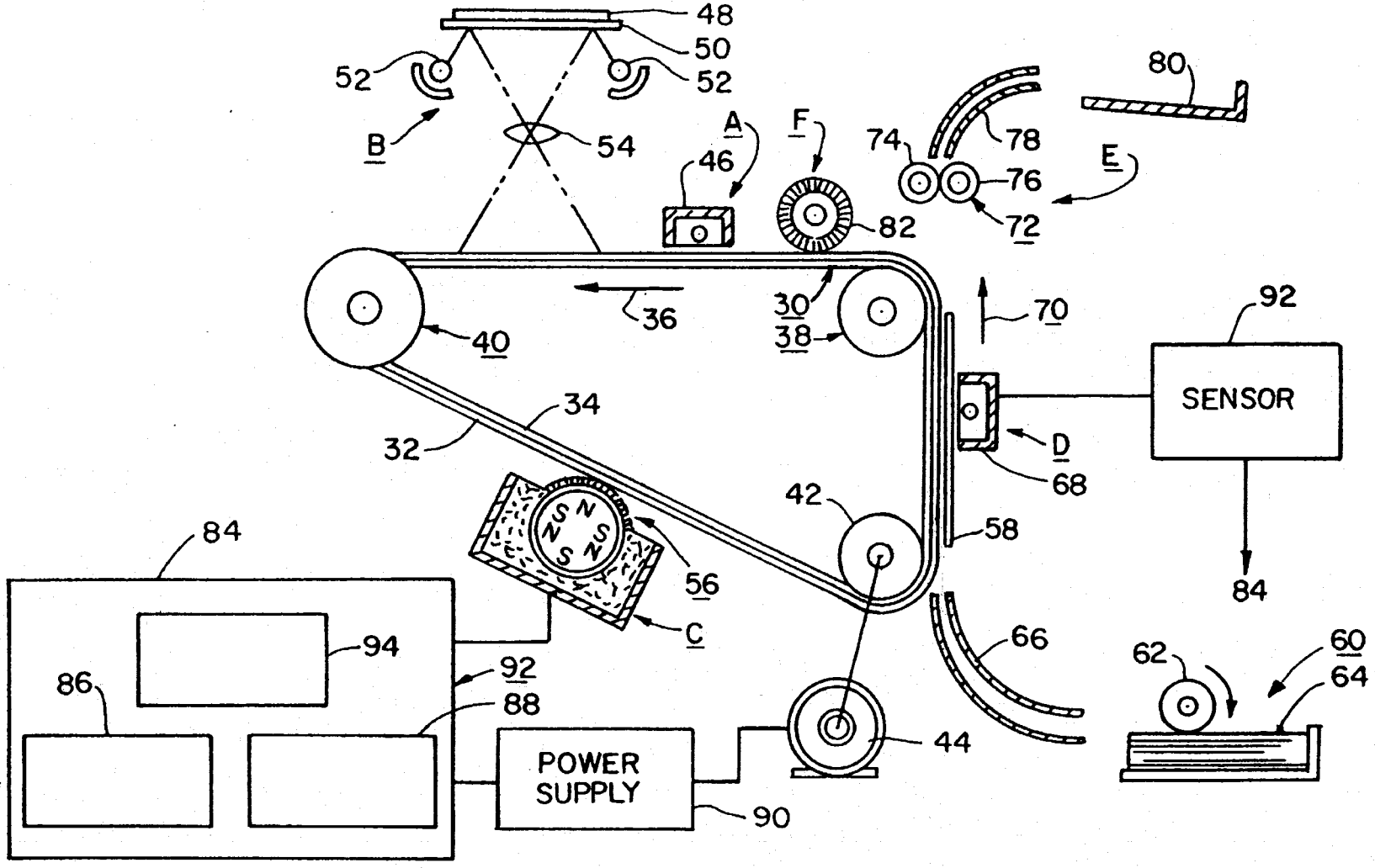
FIG. 2 is a diagrammatic illustration of a xerographic copier employing the features of an aspect of the present invention.

For a general understanding of the illustrative xerographic printing machine incorporating the features of the present invention therein, reference is had to the drawings. FIG. 2 schematically depicts the various components of an xerographic printing machine. Inasmuch as the art of xerographic printing is well known, the various processing stations employed in the FIG. 2 printing machine will be shown hereinafter schematically, and their operation briefly described.

The xerographic printing machine employs a photoreceptor belt 30 having a photoconductive surface 32 deposited on a conductive substrate 34. Preferably, photoconductive surface 32 is made from an organic material with conductive substrate 34 being made from an aluminum alloy. Belt 30 moves in the direction of arrow 36 to advance successive portions of photoconductive surface 32 sequentially through the various processing stations disposed about the path of movement thereof. Belt 30 is entrained about steering post 38, tension post 40, and drive roller 42.

Initially a portion of belt 30 passes through charging station A. At charging station A, a corona generating device, indicated generally by the reference numeral 46, charges photoconductive surface 32 of belt 30 to a relatively high, substantially uniform potential.

Next, the charged portion of photoconductive surface 32 is advanced through exposure station B. At exposure station B, an original document 48 is positioned face down upon transparent platen 50. Lamps 52 flash light rays onto the original document. The light rays reflected from the original document are transmitted through lens 54 forming a light image thereof. This light image is projected onto the charged portion of photoconductive surface 32. The charged photoconductive surface is selectively discharged by the light image of the original document. This records an electrostatic latent image on photoconductive surface 32 which corresponds to the informational areas contained within original document 48.

Thereafter, belt 30 advances the electrostatic latent image recorded on photoconductive surface 32 to development station C. At development station C, a magnetic brush developer roller 56 advances the developer mix into contact with the electrostatic latent image recorded on photoconductive surface 32 of belt 30. The developer mix comprises carrier granules having toner particles adhering triboelectrically thereto. The magnetic brush developer roller forms a chain-like array of developer mix extending in an outwardly direction therefrom. The developer mix contacts the electrostatic latent image recorded on photoconductive surface 32. The latent image attracts the toner particles from the carrier granules forming a toner powder image on photoconductive surface 32 of belt 30.

The toner powder image recorded on photoconductive surface 32 of belt 30 is then transported to transfer station D. At transfer station D, a sheet of support material 58 is positioned in contact with the toner powder image deposited on photoconductive surface 32. The sheet of support material is advanced to the transfer station by a sheet feeding apparatus 60 Preferably, a sheet feeding apparatus 60 includes a feed roll 62 contacting the uppermost sheet of the stack 64 of sheets of support material. Feed roll 62 rotates so as to advance the uppermost sheet from stack 64 into chute 66. Chute 66 directs the advancing sheet of support material into contact with the photoconductive surface 32 of belt 30 in a timed sequence so that the powder image developed thereon contacts the advancing sheet of support material at transfer station D. Transfer station D includes a corona generating device 68 which applies a spray of ions to the backside of sheet 68. This attracts the toner powder image from photoconductive surface 32 to sheet 68. After transfer, the sheet continues to move in the direction of arrow 70 and is separated from belt 30 by a detack corona generating device (not shown) neutralizing the charge thereon causing sheet 58 to adhere to belt 30. A conveyor system (not shown) advances the sheet from belt 30 to fusing station E.

Fusing station E includes a fuser assembly, indicated generally by the reference numeral 72, which permanently affixes the transferred toner powder image to sheet 58. Preferably, fuser assembly 72 includes a heated fuser roller 74 and a backup roller 76. Sheet 58, passes between fuser roller 74 and backup roller 76 with the toner powder image contacting fuser roller 74. In this manner, the toner powder image is permanently affixed to sheet 58. After fusing, chute 78 guides the advancing sheet 58 to catch tray 80 for removal from the printing machine by the operator.

Invariably, after the sheet of support material is separated from photoconductive surface 32 of belt 30, some residual particles remain adhering thereto. These residual particles are removed from photoconductive surface 32 at cleaning station F. Cleaning station F includes a rotatably mounted fiberous brush 82 in contact with photoconductive surface 32 of belt 30. The particles are cleaned from photoconductive surface 32 by the rotation of brush 82 in contact therewith. Subsequent to cleaning, a discharge lamp (not shown) floods photoconductive surface 32 with light to dissipate any residual electrostatic charge remaining thereon prior to the charging thereof for next successive imaging cycle.

It is believed that the foregoing description is sufficient for purposes of the present application to illustrate the general operation of an xerographic printing machine.

Operation of the above discussed elements, including the various stations are controlled by controller 84 which includes xerographic subsystem control 86 and machine or copier subsystem control 88.

Xerographic subsystem control 86 controls the operations necessary for xerographic copying. In particular, it controls operation of the stations A–F discussed in the preceding paragraphs. The machine subsystem control 88 controls the overall operation of the machine including energization of the elements of the device by power supply 90.

After a predetermined time sensed by sensor means 92, machines now in use, especially those which utilize organic (i.e. AMAT) photoreceptors, are typically designed so that the xerographic subsystem control 86 is deactivated (i.e. removal of bias voltage for charging, developing, transferring, etc. at stations A–F) as soon as practical after the last copy of the current job is scheduled. This deactivation is done in order to prolong the life of the photoreceptor.

This "fast" cycle-out tends to dramatically reduce productivity for those jobs which utilize manually positioned originals since the machine either cycles to standby or requires a longer restart time for each successive original. This is true since during the time when the operator is manually exchanging originals, either the xerographic subsystem control 86 cycles-down (which will result in a long restart time since it is necessary to re-enable the xerographic subsystem for several image zones prior to actual image production due to the physical dimension of the stations comprising the xerographic subsystem) or the machine control subsystem cycles-down the entire machine (which will result in an even longer original-to-original copy time). Even very proficient operators often encounter long "restart" times due to the conservative nature of the xerographic and machine subsystem control designs.

An example of what can happen in such a design is explained in connection with a copier known as Century/5100 from the Xerox Corporation. In such a copier the xerographic subsystem control effectively begins its cycle-out two (2) image zones (pitches) after the last scheduled image (assuming letter size paper, this equates to approximately 1.2 seconds after an image is committed to), which makes it virtually impossible for any operator to achieve maximum productivity via a restart. In response to even a further time the machine subsystem control 88 achieves a complete cycle-out which will be committed to after about ten (10) image zones (pitches) after the last scheduled image (about 6 seconds using the previous assumptions). Such operations which are done to conserve the photoreceptor result in numerous machine cycle-outs especially during book page turns, etc. To decrease the occurrences of these cycle-outs, an adaptive control system 94 is included. This adaptive control system 94 is used to alter the time at which the subsystems 86, 88 initiate their respective cycle-out procedures.

While some representative connections between the various elements of the xerographic machine of FIG. 2 are provided, all connections have not been included in order to maintain clarity of the FIGURE. However, it is to be appreciated that such connections would be within the understanding of one of ordinary skill in the art after reading the present detailed description.

Figure 3A:
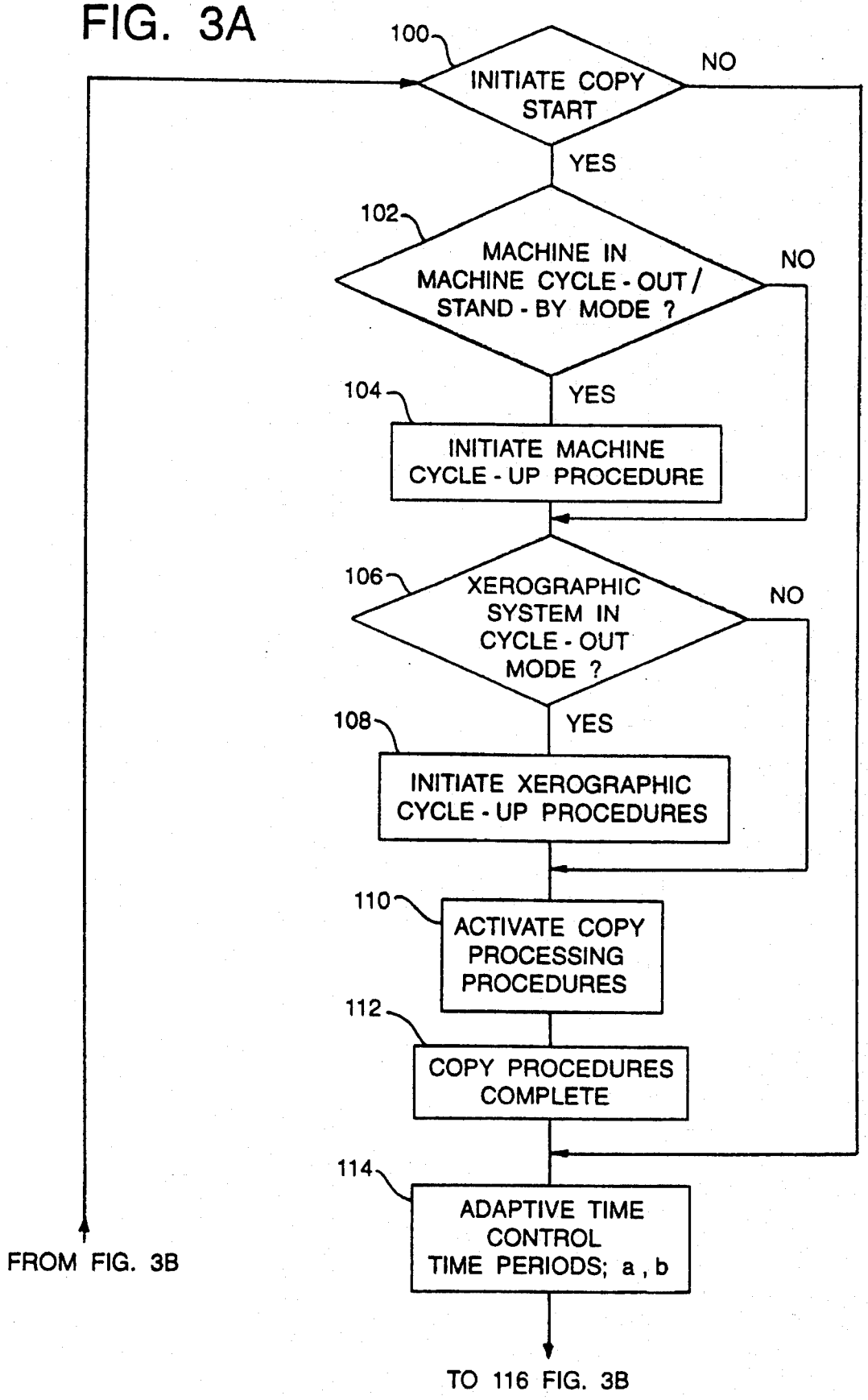
FIGS. 3A–3B are a flow chart implementing the actions of a xerographic copier of the present invention including the adaptive timing controller; and, FIG. 4 is a expanded view of the steps for the adaptive timing controller FIGS. 3A–3B.
Figure 3B:
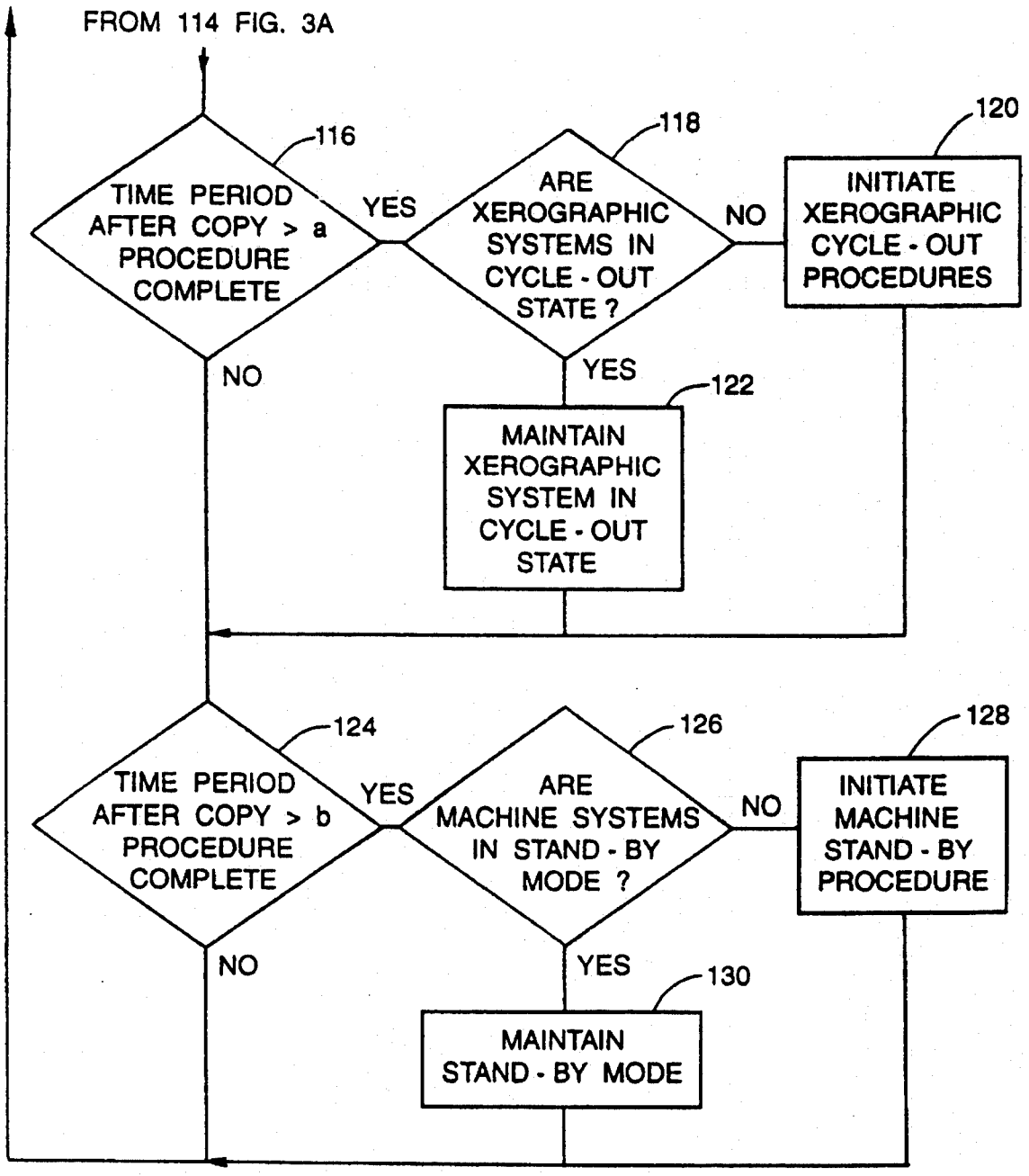

FIGS. 3A–3B provide a flow chart for a xerographic copy procedure which includes an adaptive time control procedure used by the adaptive control system 94 to allow for a more equitable compromise between manual placement job productivity and photoreceptor life. This is accomplished by providing different cycle-out times for various modes of operation. The adaptive mode provided here makes adjustments to cycle-out time to overcome annoyance and enhance receptor life.

After the xerographic machine of the present invention has been energized, a operator may initiate a copy start procedure 100. After this initiation it is determined whether the system is in a stand-by mode 102. If the machine is in stand-by a cycle-up procedure 104 is implemented to ready the system for copying. Alternatively, if the machine is not in a stand-by mode this procedure is bypassed.

Next, it is determined whether the stations A–F controlled by the xerographic subsystem control 86 have been deactivated 106. If stations A–F have been deactivated (including removal of voltage bias from photoreceptor 30) then a xerographic subsystem cycle-up procedure 108 is implemented. Alternatively, if in step 106 it is indicated the xerographic subsystem control has not deactivated stations A–F the cycle-up procedure 108 is not necessary. Control of the system is then passed to copy processing procedure 110 which includes the steps necessary to operate the machine to produce a copy of the original document. Upon completion of the copying process the procedure is ended 112.

At this point, control is passed to the adaptive time control procedure 114 which, dependent on predetermined parameters, will increase or decrease the time at which the xerographic subsystem control 86 and the machine control subsystem 88 will begin their cycle-out procedures. In step 116 it is determined whether the time period after the end of the copying procedure is greater than a first predetermined time period. When this time is greater than the predetermined time period, the process branches to step 118, where it is determined whether the cycle-out procedure has already begun. If it is not begun then the cycle-out procedure is entered 120 and if it has begun than the cycle-out procedure is maintained 122.

Next the process investigates whether the time period following the end of the copy procedure 112 is equal to or greater than a second predetermined time to determine whether to enter a machine cycle-out stage 124. Similarly, it is determined whether the machine subsystem control 88 is in its cycle-down procedure 126, if not then the machine cycle-down procedure is initiated 128. If in step 126 it is determined the machine subsystem is in a cycle-down procedure, the cycle-down procedure is maintained 130. At this point the process investigates whether another copy start has been initiated 100. If a copy start has not been initiated then the procedure is branched to the adaptive time control procedure 114 to again determine whether the time until the xerographic subsystem control 86 and the machine subsystem control 88 achieve a cycle-out time should be altered.

Figure 4:
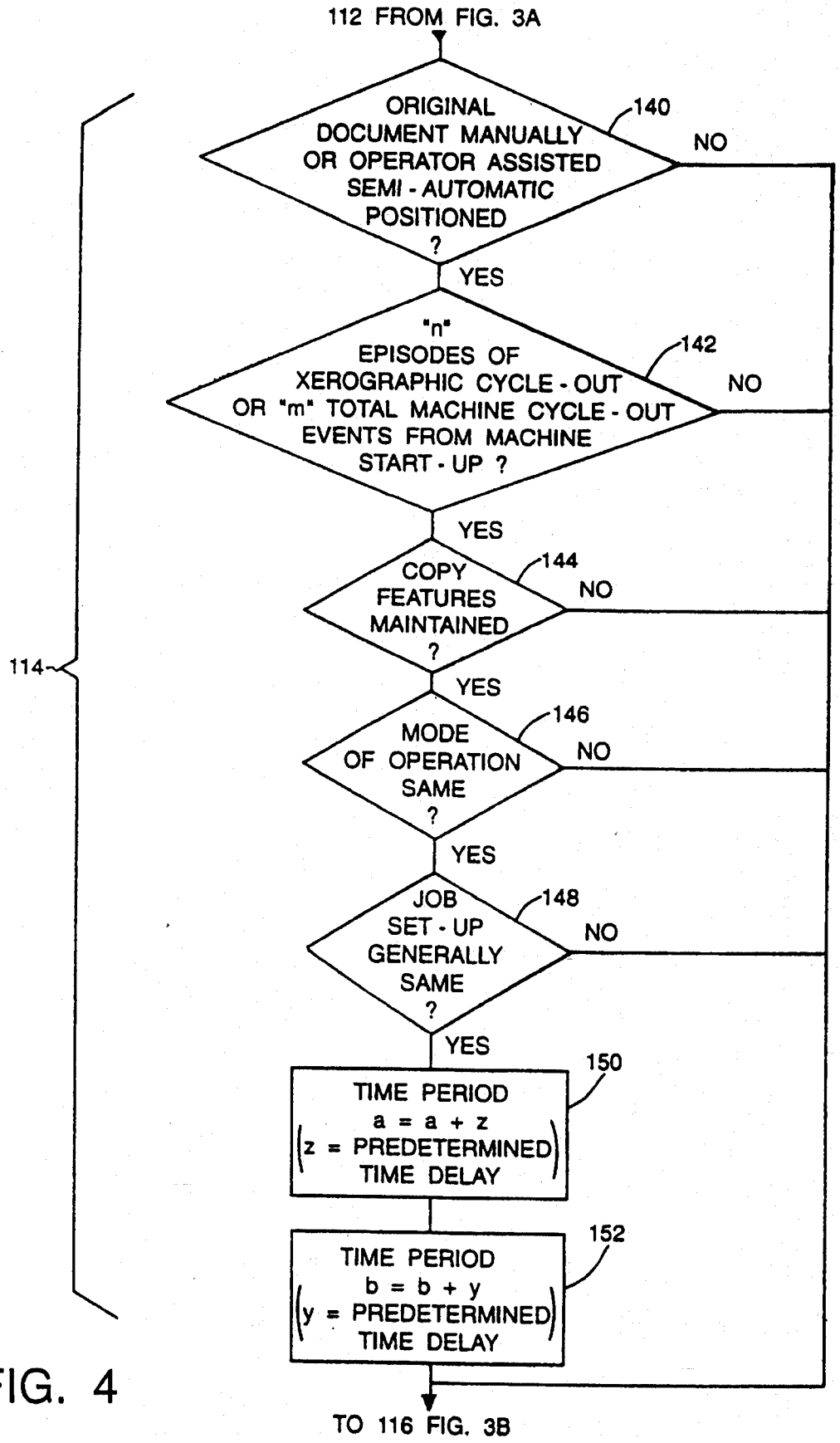

FIG. 4 sets forth a more in-depth view of the adaptive control procedure 114 of FIG. 3. This procedure checks selected parameters in order to determine whether the predetermined time periods in blocks 116 and 124 are to be maintained at existing time periods or whether those times should be altered.

The system will make an inquiry as to whether the originals were manually positioned 140; whether "n" episodes of xerographic cycle-out or "m" total cycle-out events between start-ups have occurred 142; whether various copy features have been maintained (i.e. it appears to be the "same job") 144; is the mode of operation the same (e.g.; diagnostics, job interrupt, etc.) 146; or is the job set-up generally the same (e.g.; feature "timeout", "C"/"CM" button, etc.) 148.

When the above criteria are met, it becomes practical to extend the time periods at which the xerographic subsystem control and machine subsystem control will enter their cycle-out procedures (i.e steps 116, 124), by a predetermined number of pitches or time delay, respectively. In such a situation time periods "a" and "b" of steps 150, 152 are extended. On the other hand, to prevent undesirable continuation of extended cycle-out functions beyond useful job life, the extended times will automatically cancel and be returned to base line controls, which will cause times a and b to default to an originally set time period, when any of the above steps 140–148 are determined not to meet the predetermined criteria. It is to be appreciated that other criteria or parameters may be useful in determining extension of the time periods and use of these criteria or parameters may be included in the adaptive control procedure.

The invention has been described with reference to the preferred embodiment. Obviously, modifications and alterations will occur to others upon reading and understanding the proceeding detailed description of the preferred embodiment. It is intended that the invention be construed as including all such alterations and modifications insofar as they come within the scope of the appended claims or the equivalence thereof.

Having thus described the preferred embodiment, the invention is now claimed to be:

1. A xerographic printing machine of the type which includes manual placement of original documents to be copied, the machine comprising:

a sensor configured to sense completion of copying of an original document;

a control system which removes voltage biases from the electrophotographic printing machine following a time period after the sensor senses completion of copying, the time period including a first time period after which a voltage bias is removed from a photoreceptor and a second time period after which the xerographic printing machine enters into a cycle-down procedure; and an adaptive controller arranged to adaptively control the length of said first and second time periods.

2. The xerographic printing machine according to claim 1 wherein the voltage biases are removed from elements of the xerographic printing machine, including the photoreceptor.

3. The xerographic printing machine according to claim 2 wherein the control system includes a xerographic subsystem control for controlling the bias voltage applied to the photoreceptor.

4. The xerographic printing machine according to claim 1 wherein the control system includes a machine subsystem control for controlling overall machine operation.

5. The xerographic printing machine according to claim 1 wherein the adaptive controller includes determining means for determining a status of a plurality of predetermined parameters.

6. The xerographic printing machine according to claim 5 wherein the predetermined parameters include job set-up, mode of operation, and manual or non-manual job.

7. A xerographic copier comprising:

a platen on which documents are manually placed to be copied;

a power supply;

a photoreceptor configured to receive bias voltages from the power supply during a copy procedure for copying one of the documents placed on the platen;

a sensor configured to sense completion of the copy procedure;

a completion signal generator in operative connection with the sensor and which generates a signal indicating completion of the copy procedure;

a xerographic subsystem control including means for controlling the bias voltage applied to the photoreceptor, means for removing the bias following a first time period after the end of the copy procedure, wherein the means for removing is activated upon receipt of the signal indicating completion of the copy procedure;

a copier subsystem control for controlling overall operation of the xerographic copier based on receipt of the signal indicating completion of the copy procedure, wherein the copier subsystem control enters the xerographic device into a cycle-down state following a second time period after the end of the copy procedure; and an adaptive time controller arranged to adaptively alter the length of the first and second time periods according to predetermined parameters.

8. The xerographic copier according to claim 7 wherein the photoreceptor is an organic photoreceptor.

9. The xerographic copier according to claim 8 wherein the predetermined parameters include job set-up, mode of operation and whether it is a manual or non-manual job.

10. The xerographic copier according to claim 7 wherein a predetermined status of any one of the predetermined parameters results in cancellation of extended xerographic subsystem and copier subsystem cycle-out procedures.

11. A method of controlling operation of a xerographic copier, the method comprising:

manually placing a document to be copied onto a platen of the xerographic copier;

activating a copy procedure including applying a bias voltage to a photoreceptor, the bias voltage being controlled by a xerographic subsystem control;

sensing completion of the copy procedure;

generating a completion signal indicating completion of the copy procedure for the document manually placed on the platen;

transmitting the completion signal to the xerographic subsystem control and to a copier subsystem control;

removing the bias voltage from the photoreceptor following a first time period after the end of the copy procedure;

entering the copier into a cycle-down state through operation of the copier subsystem control following a second time period after the end of the copy procedure; and adaptively altering the first and second time periods according to predetermined parameters.

12. The method according to claim 11 wherein the photoreceptor to which the bias voltage is applied is an organic photoreceptor.

13. The method according to claim 11 wherein the step of adaptively altering the first and second time periods increases the cycle-out times for the xerographic subsystem and the copier subsystem.

14. The method according to claim 11 wherein the first and second time periods are different.

15. The method according to claim 11 wherein the adaptively altering step according to predetermined parameters includes:

determining whether a mode of operation, a job set-up, and a copy feature are maintained from one copy procedure to a next copy procedure;

determining whether the document to be copied was manually positioned or assisted by an operator; and determining the number of xerographic and copier subsystem control cycle-out events which have occurred from copier start-up.

* * * * *